United States Patent [19]

Grill

[11] 4,392,341

[45] Jul. 12, 1983

[54] TWISTING MACHINE

[75] Inventor: Werner Grill, Kempten, Fed. Rep. of Germany

[73] Assignee: Saurer-Allma GmbH, Kempten, Fed. Rep. of Germany

[21] Appl. No.: 379,413

[22] Filed: May 18, 1982

[30] Foreign Application Priority Data

May 21, 1981 [DE] Fed. Rep. of Germany ... 8115081[U]

[51] Int. Cl.[3] ..... D01H 1/02; D01H 13/04

[52] U.S. Cl. ..... 57/90; 57/352

[58] Field of Search ..... 57/90, 91, 58.83, 66, 57/75, 352–354, 358, 359

[56] References Cited

U.S. PATENT DOCUMENTS

| | | | |
|---|---|---|---|
| 2,882,675 | 4/1959 | Tingas | 57/90 X |
| 3,344,595 | 10/1967 | Johnson | 57/352 |
| 3,475,896 | 11/1969 | Gibson et al. | 57/352 X |
| 3,651,630 | 3/1972 | Gemeinhardt | 57/90 X |
| 3,780,516 | 12/1973 | Kimbrell | 57/90 X |
| 3,781,953 | 1/1974 | Stegelman | 57/90 X |
| 4,229,404 | 10/1980 | Hatcher et al. | 57/352 X |

*Primary Examiner*—John Petrakes

*Attorney, Agent, or Firm*—Flynn, Thiel, Boutell & Tanis

[57] ABSTRACT

A twisting machine for twisting several filament yarn strands which are preferably an aramid (aromatic polyamide) and wound on spools, has a creel for supporting the spools, a delivery system which includes several feed rollers, and a first thread guide which is supported before the delivery system along the strand paths for movement back and forth in directions parallel to the axes of the delivery rollers. The first thread guide is a cylindrical first guide roller which has a circumferential guide groove for each yarn strand and is rotatable about an axis which extends parallel to the feed roller axes. A second cylindrical guide roller is arranged following the delivery system along the strand paths, is freely supported for rotation about an axial movement along an axis which is parallel to the feed roller axes, and has a circumferential guide groove for each yarn strand. A spindle for supporting the winding bobbin is provided, and along an extension of the spindle axis a second thread guide is provided which has a guide eyelet for each yarn strand. Below the second thread guide is a third thread guide having an opening through which all the yarn strands are guided.

7 Claims, 3 Drawing Figures

TWISTING MACHINE

FIELD OF THE INVENTION

This invention relates to a twisting machine for twisting several yarn strands wound on spools.

BACKGROUND OF THE INVENTION

A typical machine of this type includes a creel for supporting the spools, a delivery system which includes several feed rollers, and a first thread guide arranged before the delivery system along the strand paths, supported for back and forth movement parallel to the axes of the feed rollers, and having a guideway for each yarn strand. A thread-guiding mechanism follows the delivery system along the strand paths, a spindle is provided for supporting a winding bobbin, and a second thread guide is arranged along an extension of the axis of the spindle and has a guide eyelet therein for each yarn strand. A third thread guide is arranged below the second thread guide and has an opening through which all the yarn strands pass together.

The known ring twisting machines of the above-mentioned type are not well-suited for use with filament yarn strands made of aramid (aromatic polyamide), for example, that which is presently available under the trademark "Kevlar". Aramids have, based on their molecular structure, an extremely small capacity to stretch and a very high tensile strength. Twisted yarns of aramid are therefore used in products which must remain pliable under high tensile loads, for example car tires and drive belts. The processing of aramid fibers to produce a twisted yarn requires special measures with respect to the thread-guiding parts, since the fiber, in a nontwisted condition, can be seriously affected by damage to its surface. If damaged, a strong notching effect occurs, as in the case of steel, which considerably reduces the strength of the fiber. Furthermore, because of the minimal capacity of aramid fibers to stretch, it is important that all individual fibers in any part of the finished twisted yarn have, as much as possible, the same length, so that they carry a load as equally as possible. Uneven lengths of the fibers can cause an overload of the shorter fibers and tearing thereof when the yarn is stressed, since the longer fibers carry no load at all.

A production speed which is as high as possible is desired for economical manufacture of the twisted yarn. However, the higher the production speed, the greater the danger of damage of the filaments and movement of the filaments which causes them to be twisted into the yarn with uneven lengths. In known twisting machines, a danger of yarn damage is present primarily at the reciprocating thread guide provided along the strand paths between the spools and the delivery system. This known thread guide has, as guideways for the individual yarn strands, wire bars, on which the yarn strands are relatively sharply deflected. This can result in filaments being either moved or damaged. Furthermore, damage of the filaments can occur at the thread-guiding mechanism which follows the delivery system, since in the known system it is a simple, fixedly supported rod.

A basic purpose of the invention is therefore to provide a twisting machine of the above-mentioned type in which the manufacture of twisted yarn from filament yarn strands is possible at high speeds, but in which damage, movement and irregular feeding of the filaments is avoided.

SUMMARY OF THE INVENTION

This purpose is attained according to the invention by providing as the first thread guide a freely rotatable first guide roller which has a respective circumferential guide groove for each yarn strand and can be rotated about an axis which extends parallel to the feed roller axes, and by providing as the thread-guiding mechanism a second guide roller which is freely rotatably supported about and is movable along an axis arranged parallel to the feed rollers, and which has a circumferential guide groove for each yarn strand.

The filament yarn strands are thus guided in a very protected manner, before and after passing through the delivery system, by the two guide rollers which are provided with guide grooves. Since the yarn strands roll along the guide rollers and do not slide on them, damage and movement of the filaments are avoided. The guide grooves in the guide rollers ensure that the individual yarn strands are always held apart and cannot become superposed or crossed before the final twisting together after the second thread guide. Through this, it is assured that fibers of the same length are always present in any given section of the yarn, which fibers then carry loads equally. Thus, a twisted yarn with a very high strength is achieved.

BRIEF DESCRIPTION OF THE DRAWINGS

The present invention will be described in greater detail hereafter in connection with exemplary embodiments which are illustrated in the drawings, in which.

DETAILED DESCRIPTION

Figures 1, 2:
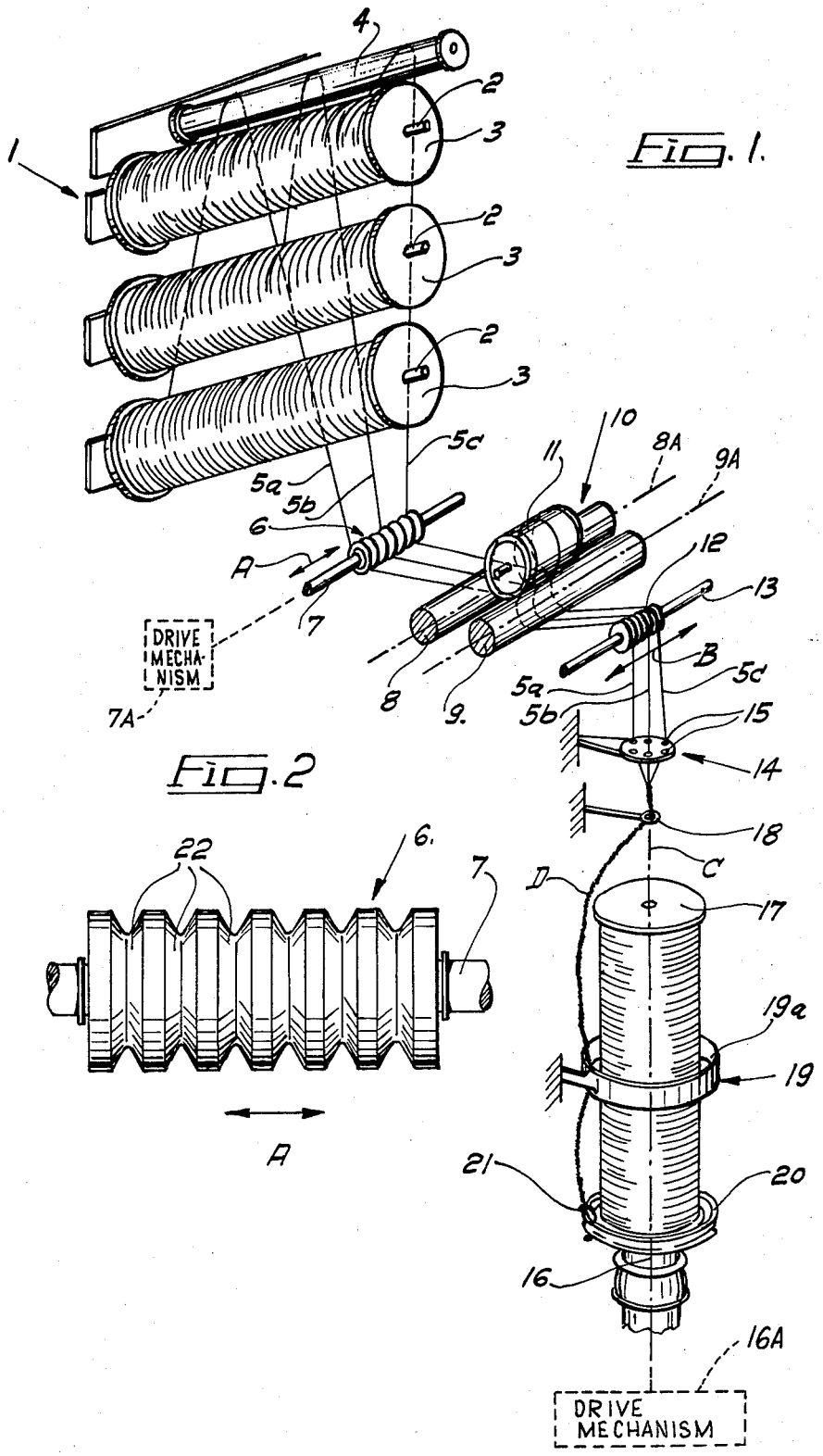
FIG. 1 is a perspective view of part of a twisting machine embodying the present invention.
FIG. 2 is a side view of a guide roller which is a component of the machine of FIG. 1.

A creel 1 has several parallel pins 2 for supporting respective spools 3 having yarn strands 5*a*, 5*b* and 5*c* wound therearound. Depending on the number of strands desired in the resulting twisted yarn, it is possible to use up to eight spools 3 for manufacturing a single twisted yarn. The spools 3 are rotatable on the pins 2.

A cylindrical guide roller 4 is rotatably supported on the creel 1 parallel to the spools 3 and next to the top spool 3, over which guide roller 4 are guided to the respective filament yarn strands 5*a*, 5*b* and 5*c*. The guide roller 4 has a smooth, polished surface.

The yarn strands 5*a*, 5*b* and 5*c* are then guided downwardly and around a first generally cylindrical guide roller 6. The guide roller 6 is rotatably supported on but fixed against axial movement with respect to an axle 7. The axle 7 extends parallel to the respective axes 8A and 9A of cylindrical, rotatably supported feed rollers 8 and 9 which are part of a delivery system 10. The feed rollers 8 and 9 are made of metal. A cylindrical pressure roller 11 having a diameter greater than the distance between the two feed rollers 8 and 9 rests thereon, as shown in FIG. 1, and is part of the delivery system 10. The surface of the pressure roller 11 is provided with a rubber coating which has a Shore hardness in the range of 70 to 80 and is smoothly finished.

As shown in FIG. 1, the strands 5*a*, 5*b* and 5*c* pass under the feed roller 8, upwardly between the feed rollers 8 and 9, around the pressure roller 11, downwardly between the feed rollers 8 and 9, and under the feed roller 9.

In order that the filament yarn strands 5*a*, 5*b* and 5*c* which extend around the pressure roller 11 do not damage the rubber coating thereon, the axle 7 is constantly moved back and forth in an axial direction as indicated by arrow A. In this manner, the yarn strands 5*a*, 5*b* and 5*c* are each continuously shifting axially with respect to the roller 11, thereby avoiding substantially continuous contact between any strand and any given point on the surface of the pressure roller 11.

The axial reciprocation of the axle 7 is effected by a drive mechanism 7A which could, for example, include a spring urging one end of the axle 7 into engagement with the peripheral edge of a circular cam mounted eccentrically on a rotating shaft.

A further cylindrical guide roller 12 is provided on the side of the delivery system 10 opposite the roller 6 and is supported for rotational movement on and axial movement in the direction of arrow B with respect to an axle 13. The axle 13 extends parallel to the axes 8A and 9A of the feed rollers 8 and 9. The guide roller 12 can thus move freely on its axle 13 and will always assume an axial position determined by the axial position of the yarn strands 5*a*, 5*b* and 5*c*. With this, it is achieved that the movement of the yarn strands 5*a*, 5*b* and 5*c* is influenced as little as possible by the guide roller 12. Also, the guide roller prevents damage to the filaments 5*a*, 5*b* and 5*c*.

In order that the yarn strands 5*a*, 5*b* and 5*c* are influenced as little as possible by the guide rollers 6 and 12, it is advantageous if these rollers are made of a smooth and wear-resistant plastic, preferably a polyamide.

Furthermore, it is advantageous if the second guide roller 12 is positioned at approximately the same height as the feed roller 9 of the delivery system 10 in order to obtain a thread length which is as long as possible between the guide roller 4 and a second thread guide 14.

The second thread guide 14 is a horizontal plate which is supported below the guide roller 12 and has a separate guide eyelet 15 therein for each of the yarn strands 5*a*, 5*b* and 5*c*. Each of the guide eyelets 15 is preferably spaced the same radial distance from the axis C of a spindle 16. The spindle 16 supports a winding bobbin 17 and is rotatably driven in a conventional manner by a conventional drive mechanism 16A. A third thread guide 18 is a member supported below the second thread guide 14 along the axis C of the spindle 16 and having a single opening therein coaxial with the axis C and through which the strands 5*a*, 5*b* and 5*c* all pass.

As shown in FIG. 1, the twisting of the yarn strands occurs between the second and third thread guides 14 and 18 through the action of a conventional runner 21 and twister ring 20.

Furthermore, in order to limit the diameter of the path of movement of the twisted yarn D, a limiting ring 19 is advantageously provided which surrounds the bobbin 17 and is spaced radially therefrom. The inner surface 19*a* of the limiting ring 19, which comes into contact with the twisted yarn D, is preferably made of a low friction plastic.

The twisted yarn D then runs in a conventional manner through the runner 21 which rotates on the twister ring 20 and is wound onto the bobbin 17.

FIG. 2 illustrates the guide roller 6 of FIG. 1 in a larger scale. As one can recognize, the guide roller 6 has, for each yarn strand a circumferential guide groove 22. Similarly, the second guide roller 12 is also provided with a circumferential guide groove (FIG. 1) for each yarn strand.

It is possible, with the described ring twisting machine, for filament yarn strands 5*a*, 5*b* and 5*c* which are not twisted, or which are provided with only a weak twist, to be processed in a single operation at high production speeds into a twisted yarn having high strength and without the danger of damaging the filaments.

Figure 3:
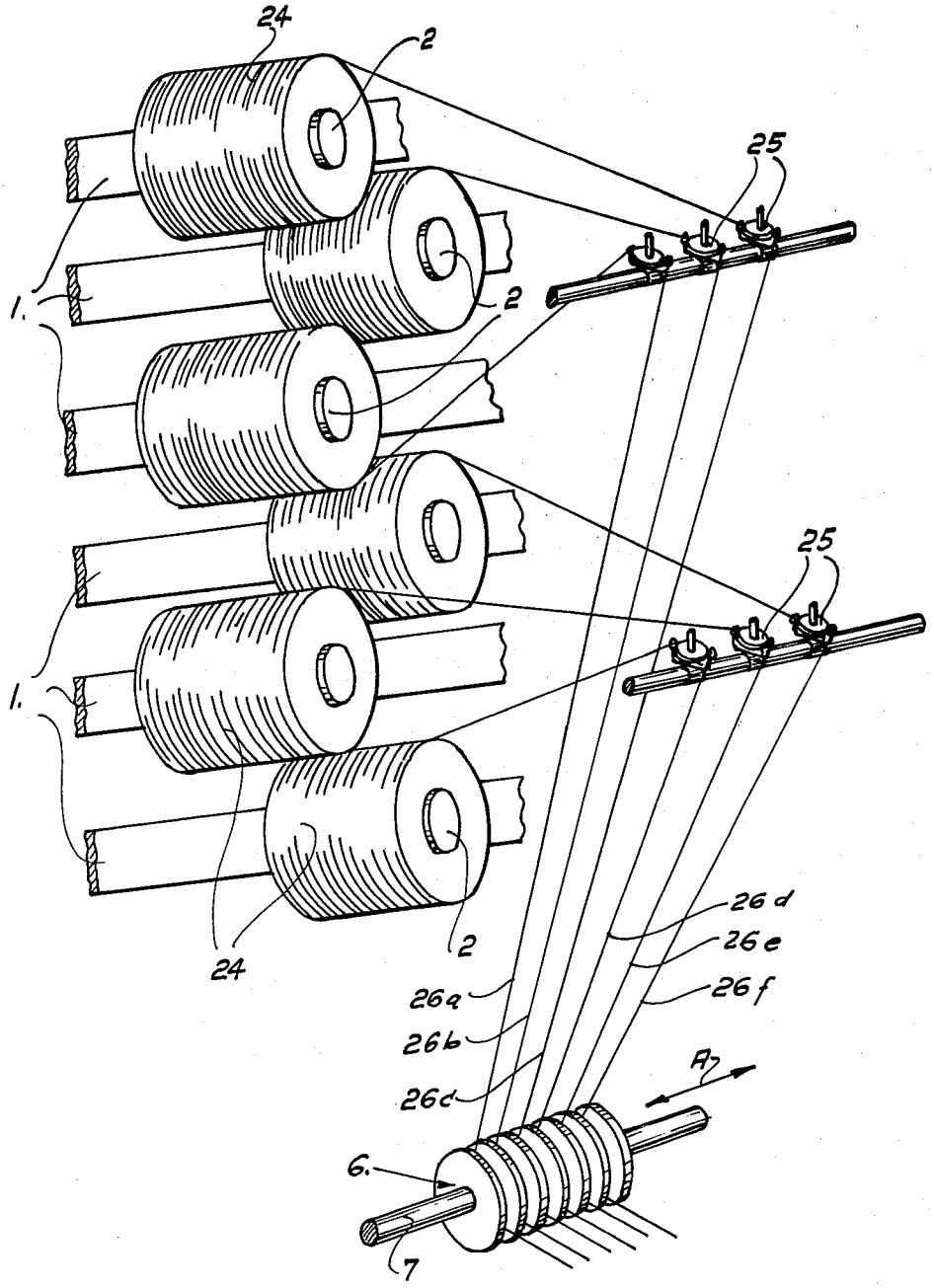
FIG. 3 is a perspective view of an alternative embodiment of part of the embodiment of FIG. 1.

In this case, according to FIG. 3, several spools 24 are supported on the creel 1, each carrying a nontwisted or a weakly twisted filament yarn strand. Each filament yarn strand is, in this case, not unwound by rotating the associated spool 24 but by pulling the strand axially of the spool 24. Each spool 24 has a thread brake 25 associated with it and supported nearby, the surfaces of the thread brakes which come into contact with the filament yarn being made of a wear-resistant and low friction material, preferably a glazed porcelain. The thread brakes 25 ensure a controlled removal of the yarn strands 26*a* to 26*f* from the spools 24. The thread then passes over the guide roller 6, which is moved back and forth in the axial directions A, and then to apparatus which is the same as that described for the embodiment of FIG. 1, including the delivery system 10 and guide roller 12.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a machine for twisting several filament yarn strands wrapped on spools, including a creel for supporting the spools, a delivery system which includes several feed rollers, a first thread guide supported along the thread path between the spools and the delivery system for movement back and forth in directions parallel to the axes of the feed rollers and having a guideway for each of the yarn strands, thread-guiding means following the delivery system, a rotatable spindle for supporting a winding bobbin, a second thread guide arranged along an extension of the axis of the spindle and having a respective guide eyelet for each yarn strand, and a third thread guide which follows the second thread guide and has an opening through which all yarn strands are guided together, the improvement comprising wherein the first thread guide is a first guide roller which has a circumferential guide groove for each yarn strand and is freely rotatable about an axis which extends generally parallel to the feed roller axes, and wherein the thread-guiding means includes a second guide roller which is supported for rotational and axial movement with respect to an axis generally parallel to the feed roller axes and which has a circumferential guide groove for each yarn strand.

2. The machine according to claim 1, wherein the guide rollers are made of a smooth, wear-resistant plastic, preferably a polyamide.

3. The machine according to claim 1 or claim 2, wherein the second guide roller is arranged at apoproximately the same height as one of the feed rollers of the delivery system.

4. The machine according to claim 1, wherein, along the thread path between the spools and the first guide roller, there is provided a guide roller having a smooth and polished surface, all the yarn strands being guided thereover.

5. The machine according to claim 1, wherein the delivery system includes a pressure roller having a rubber coating.

6. The machine according to claim 1, wherein the guide eyelets of the second thread guide are each spaced substantially the same distance from the axis of the spindle.

7. The machine according to claim 1, wherein the bobbin is surrounded by a limiting ring, the inner surface thereof contacting the twisted yarn and being made of a low friction material, preferably a plastic.

* * * * *